US010046335B2

(12) United States Patent
Sato et al.

(10) Patent No.: US 10,046,335 B2
(45) Date of Patent: Aug. 14, 2018

(54) CENTRIFUGE FOR PIVOTING THE ROTATING SHAFTS OF THE SAMPLE CONTAINER AND SWING ROTOR FOR CENTRIFUGE

(71) Applicant: Hitachi Koki Co., Ltd., Tokyo (JP)

(72) Inventors: Jun Sato, Ibaraki (JP); Kenichi Nemoto, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 15/307,378

(22) PCT Filed: Apr. 27, 2015

(86) PCT No.: PCT/JP2015/062678
§ 371 (c)(1),
(2) Date: Oct. 28, 2016

(87) PCT Pub. No.: WO2015/166906
PCT Pub. Date: Nov. 5, 2015

(65) Prior Publication Data

US 2017/0050196 A1 Feb. 23, 2017

(30) Foreign Application Priority Data

Apr. 30, 2014 (JP) ..... 2014-093639

(51) Int. Cl.
*B01F 5/04* (2006.01)
*B04B 9/00* (2006.01)
(Continued)

(52) U.S. Cl.
CPC ..... *B04B 9/00* (2013.01); *B04B 5/02* (2013.01); *B04B 5/0421* (2013.01)

(58) Field of Classification Search
CPC ..... B04B 5/0421; B04B 5/02; B04B 9/00
(Continued)

(56) References Cited

U.S. PATENT DOCUMENTS 3,722,791 A * 3/1973 Wright ..... B04B 5/0421 494/20
4,400,166 A * 8/1983 Chulay ..... B04B 5/0421 494/20
(Continued)

FOREIGN PATENT DOCUMENTS

GB 505446 * 5/1939
JP H09-155237 6/1997
(Continued)

OTHER PUBLICATIONS

"International Search Report (Form PCT/ISA/210)", dated Aug. 11, 2015, with English translation thereof, pp. 1-4.

*Primary Examiner* — Charles Cooley
(74) *Attorney, Agent, or Firm* — JCIPRNET

(57) ABSTRACT

A centrifuge including a lid section of a sample container, the lid section having a rotating shaft for swinging, and a swing-type rotor, and the centrifuge conducts centrifugation operation in a state where the sample container is seated in a bucket housing section by making the sample container in which the rotating shaft is mounted to a rotating shaft engagement groove of the rotor swing due to the rotation of the rotor. The rotating shaft comprises a plurality of members connected by a connection section and is configured so as to be bendable at the connection section by a centrifugal load accompanying the rotation of the rotor.

14 Claims, 15 Drawing Sheets

(51) Int. Cl.
*B04B 5/02* (2006.01)
*B04B 5/04* (2006.01)

(58) Field of Classification Search
USPC ..... 494/16–21, 12, 31, 33, 43, 81; 422/548
See application file for complete search history.

(56) References Cited

U.S. PATENT DOCUMENTS

| | | | | | |
|---|---|---|---|---|---|
| 5,681,258 | A * | 10/1997 | Lowe | B04B 5/0421 | 494/20 |
| 9,757,739 | B2 * | 9/2017 | Sato | B04B 5/0421 | |
| 2011/0183829 | A1 * | 7/2011 | Nemoto | B04B 5/0421 | 494/20 |

FOREIGN PATENT DOCUMENTS

| | | |
|---|---|---|
| JP | 2002-536169 | 10/2002 |
| JP | 2005-512786 | 5/2005 |
| JP | 2011-147908 | 8/2011 |
| JP | 2015-116544 | 6/2015 |

* cited by examiner

CENTRIFUGE FOR PIVOTING THE ROTATING SHAFTS OF THE SAMPLE CONTAINER AND SWING ROTOR FOR CENTRIFUGE

CROSS-REFERENCE TO RELATED APPLICATIONS

This application is a 371 of international application of PCT application serial no. PCT/JP2015/062678, filed on Apr. 27, 2015, which claims the priority benefit of Japan application no. 2014-093639, filed on Apr. 30, 2014. The entirety of each of the above-mentioned patent applications is hereby incorporated by reference herein and made a part of this specification.

BACKGROUND OF THE INVENTION

Field of the Invention

The invention relates to a centrifuge for separating a sample in the fields of medicine, pharmacy, genetic engineering, biotechnology, and so on, and particularly relates to improvement of a rotating shaft structure for use in a centrifuge with a swing type rotor and a sample container for the centrifuge.

Description of Related Art

A centrifuge is a device, which includes a rotor capable of housing a plurality of sample containers filled with samples therein and a driving means, such as a motor, rotationally driving the rotor in a rotor chamber, and rotates the rotor at a high speed to apply a centrifugal force, so as to centrifugally separate the samples in the sample containers. Centrifuge rotors can be roughly divided into two types, i.e. angle rotor and swing rotor. In the case of the angle rotor, a plurality of sample containers filled with samples therein are housed in housing holes, and a lid is fastened to the rotor above the opening parts of the housing holes for windage loss reduction and prevention of scatter of the samples and container debris when the sample containers break or deform. The housing holes are formed at a certain fixed angle with respect to the driving shaft, and the relative angle between the housing holes and the driving shaft is fixed at all times regardless of the centrifugal force.

In contrast, the swing rotor has a structure that the sample container filled with the sample is housed in a bucket, which has a bottomed part, and sealed by the lid covering the inside of the bucket and a sealing member, such as an O-ring, at a contact surface between the sample container and the lid, and a rod-shaped or convex rotating shaft disposed on the bucket or the lid is engaged with rotating shaft engagement grooves formed on the rotor, so as to dispose the bucket in the rotor in a swingable manner to perform centrifugal separation. The central axis of the bucket and the driving shaft of the motor are parallel to each other ($\theta=0°$) when the rotor is stationary. However, as the rotation speed increases, the bucket disposed in the swingable manner is affected by the centrifugal force to rotate around the rotating shaft so that $\theta>0°$, and then becomes substantially horizontal ($\theta\approx90°$) when a rotation speed that generates a centrifugal force sufficient to make the bucket horizontal is reached. Thereafter, the centrifugation operation ends, and $\theta$ decreases as the rotation speed drops and becomes 0° ($\theta=0°$) when the rotation of the rotor stops. Thus, the relative angle between the central axis of the bucket and the driving shaft of the swing rotor changes according to the centrifugal force during the centrifugation operation. In addition, there are mainly two types of forms for holding the centrifugal load of the bucket during the centrifugation operation of the swing rotor. One form is that the convex parts of the rotating shaft disposed on the rotor or the bucket are received by the opposing concave parts and the load caused by the centrifugal force of the bucket is held only by the convex parts or the concave parts. The other form is that the bucket is swung to the horizontal by the rotating shaft disposed on the rotor or the bucket, and from there, the rotating shaft is bent to seat the bucket on a wall surface of the rotor, such that the load caused by the centrifugal force of the bucket is held by the rotor body (see Patent Literature 1, for example).

PRIOR ART LITERATURE

Patent Literature

Patent Literature 1: Japanese Patent Publication No. 2011-147908

SUMMARY OF THE INVENTION

Problem to be Solved

In terms of the form that swings the bucket to the horizontal by the rotating shaft disposed on the rotor or the bucket and from there bends the rotating shaft to seat the bucket on the rotor, so as to hold the load caused by the centrifugal force of the bucket with the rotor body, as disclosed in Patent Literature 1, conventionally it is inevitable to increase the section modulus to ensure the strength of the rotating shaft itself such that the rotating shaft is not broken under the centrifugal force caused by its own weight or the load of the bucket caused by the centrifugal force, but it results in the problem of a larger structure. Moreover, for the convenience of ensuring the strength, an aluminum alloy that is inexpensive and has a small specific gravity may be used, but usually it does not suffice as the rotating shaft that is to be used in the swing rotor for generating centrifugal acceleration of 100,000×g or more. The conventional idea is to prevent breakage by enhancing the rigidity of the rotating shaft, but there is a limit as the centrifugal acceleration increases. Conventionally, titanium that is expensive but has a small specific gravity and a high specific strength or stainless steel that is inexpensive but has a large specific gravity are often used to form the rotating shaft. Nevertheless, using titanium as the material is costly. In addition, titanium is difficult to cut as compared to the aluminum alloy or stainless steel, which will increase the production costs and inevitably raise the sales price for the customers and impose a cost burden on the purchasers.

In the case of using stainless steel as the material of the rotating shaft, it will be heavier even in the same shape as those made of aluminum alloy or titanium alloy for the specific gravity of stainless steel is about 2 to 3 times larger. In order to withstand the centrifugal force of its own weight, the rigidity has to be increased and the structure becomes bigger. As a result, the load weight on the rotor increases. As the load weight applied on the rotor increases, the rotor body also needs to be designed to be firm with use of a strong material, so as to withstand the load weight, and consequently the overall product price rises.

In view of the above, the invention provides a centrifuge and a sample container for the centrifuge that can reduce the load weight on the rotor without causing breakage or deformation of the rotating shaft even if the rotating shaft is made to be light in weight, so as to solve the aforementioned problem.

Solution to the Problem

In view of such problems, a centrifuge of the invention includes a sample container, which includes a rotating shaft for swing, and a swing type rotor, which includes a through hole penetrating from an upper side to a lower side in an axial direction, a pair of support parts rotatably supporting two ends of the rotating shaft of the sample container mounted in the through hole, and a cutout part formed on a radial outer side in a direction perpendicular to a central axis of the through hole, and swings the sample container with the rotating shaft mounted to the support parts by rotation of the rotor to perform a centrifugation operation in a state where the sample container is seated on the cutout part. The rotating shaft includes a plurality of members connected by a connection part and is bendable at the connection part by a centrifugal load that accompanies the rotation of the rotor. Furthermore, the centrifuge of the invention may be configured such that, after the sample container is swung by the rotation of the rotor, the sample container is seated on the cutout part by bending of the rotating shaft at the connection part. Furthermore, the centrifuge of the invention may be configured such that the sample container includes a container part housing a sample and a lid part sealing the container part, the sample container has a seating surface to be seated on the cutout part during the swing, the lid part includes a disc part for covering an opening part of the container part and a hollow part formed integrally above the disc part, the rotating shaft is assembled such that the connection part is located in the hollow part, and an urging means is disposed in the hollow part for urging such that the connection part is not bent. Furthermore, the centrifuge of the invention may be configured such that the hollow part includes a longitudinal hole as a hollow part through hole which is penetrated by the rotating shaft and has a predetermined length in a longitudinal direction of the container part, and the rotating shaft protruding from the longitudinal hole on two sides is respectively movable in the longitudinal direction along the longitudinal hole by the bending at the connection part. Furthermore, the centrifuge of the invention may be configured such that a shaft diameter of a shaft part of the rotating shaft is smaller than a diameter of the connection part, and the hollow part through hole is formed in a substantially T shape in a side view by a circumferential hole and the longitudinal hole, wherein the circumferential hole has a predetermined length in a circumferential direction for inserting the connection part of the rotating shaft into the hollow part. Furthermore, the centrifuge of the invention may be configured such that the rotating shaft is connected rotatably at the connection part by a pin disposed in the hollow part and is bendable with the pin as a fulcrum. Furthermore, the centrifuge of the invention may be configured such that, with respect to the rotating shaft, the centrifugal load is supported by the pair of support parts of the rotor and the pin in the centrifugation operation in the state where the sample container is seated on the cutout part. Furthermore, the centrifuge of the invention may be configured such that the connection part has a contact surface that is parallel to an axial direction of the rotating shaft, and the urging means urges a spacer having a planar contact surface toward the contact surface of the connection part. Furthermore, the centrifuge of the invention may be configured such that the urging means and the spacer are interposed between a stopper disposed in the hollow part and the contact surface of the connection part. Furthermore, the centrifuge of the invention may be configured such that the urging means is a plurality of stacked disc springs, and the stopper is a screw that is screwed in a direction perpendicular to an axial direction of the hollow part. Furthermore, the centrifuge of the invention may be configured such that the two ends of the rotating shaft supported by the support parts of the rotor respectively have a substantially hemispherical rotating shaft end surface, and the shaft diameter of the shaft part of the rotating shaft is smaller than a diameter of the rotating shaft end surface. In addition, a swing rotor for a centrifuge according to the invention includes a through hole penetrating from an upper side to a lower side in an axial direction, a pair of support parts rotatably supporting two ends of a rotating shaft of a sample container mounted in the through hole, and a cutout part formed on a radial outer side in a direction perpendicular to a central axis of the through hole. The rotating shaft of the sample container includes a plurality of members connected by a connection part and is bendable at the connection part by a centrifugal load that accompanies rotation of the rotor.

Effects of the Invention

According to the invention, the load weight applied on the rotating shaft and the bending moment can be significantly reduced to half or less of those of the conventional technology, and the rotating shaft can be used without breakage or deformation even if the rotating shaft is made to be light in weight and repeatedly receives bending stress in each centrifugation operation. Since the load weight on the rotor can be reduced, the effect of prolonging the lifespan of the rotor and the rotating shaft to reduce the costs is achieved.

DESCRIPTION OF THE EMBODIMENTS

Figure 1:
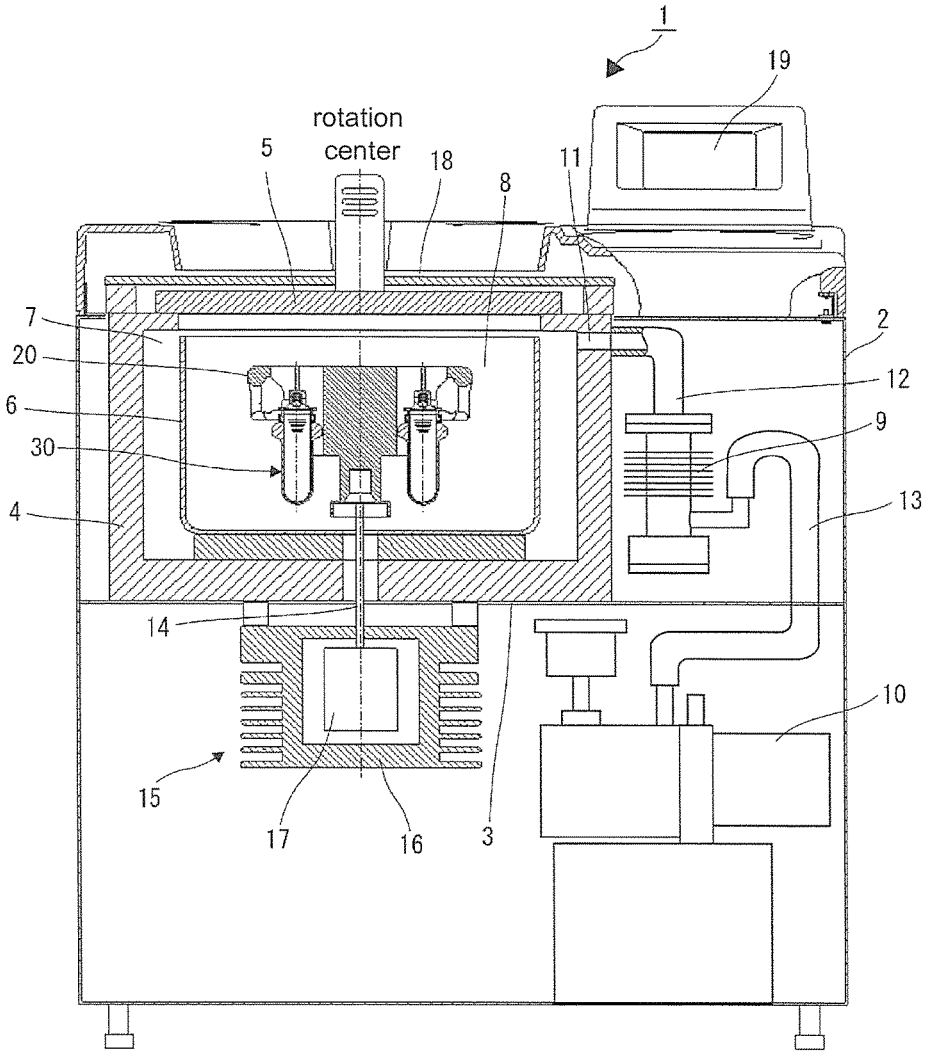
FIG. 1 is a longitudinal cross-sectional view showing the overall configuration of the first embodiment of the centrifuge according to the invention.

Hereinafter, embodiments of the invention are described specifically with reference to the figures. Identical or equivalent components, members, processes, and so on, as shown in the figures, are assigned with the same reference numerals, and repeated descriptions will be omitted. Moreover, in this specification, the up-and-down direction refers to the direction shown in the figures.

First Embodiment

Referring to FIG. 1, a centrifuge 1 of the first embodiment is housed in a box-shaped case 2 that is made of sheet metal or plastic, and the interior of the case 2 is partitioned into an upper space and a lower space by a horizontal partition plate 3. A protective wall 4 is disposed in the upper space. The protective wall 4 and a door 5 define a decompression chamber 7 where a bowl 6 is housed. Then, by closing the door 5, the decompression chamber 7 is sealed by a door packing (not shown). The bowl 6 has a cylindrical shape that is open on the upper side. A rotor 20, on which a sample container 30 is disposed in a swingable manner, is housed in an interior space (rotor chamber 8) of the bowl 6.

An oil diffusion vacuum pump 9 and an oil rotation vacuum pump 10 are connected in series to serve as a vacuum pump for discharging the atmosphere in the decompression chamber 7 to create a vacuum (decompression). That is, a vacuum drawing opening 11 formed on the protective wall 4 that defines the decompression chamber 7 and a suction port of the oil diffusion vacuum pump 9 are connected by a vacuum pipe 12, and a discharge port of the oil diffusion vacuum pump 9 and a suction port of the oil rotation vacuum pump 10 are connected by a vacuum pipe 13. Because the oil diffusion vacuum pump 9 cannot draw a vacuum from the atmospheric pressure during decompression of the decompression chamber 7, vacuum drawing is carried out by the oil rotation vacuum pump 10 first. Then, when the oil diffusion vacuum pump 9 operates, the decompression chamber 7 is decompressed by the oil diffusion vacuum pump 9 and the oil rotation vacuum pump 10. The oil diffusion vacuum pump 9 includes a boiler for storing oil, a heater for heating the boiler, a jet for ejecting the oil molecules vaporized by the boiler in a certain direction, and a cooling part for cooling the vaporized oil molecules to liquefy the vaporized oil molecules.

The rotor 20 is a swing rotor for a swing type centrifuge, which is rotatable around a driving shaft 14 serving as the rotation axis and rotates at a high speed while holding a sample that is to be separated. FIG. 1 illustrates a state where the rotor 20 is stopped and the central axis of the sample container 30 is in the vertical direction. The rotor 20 of this embodiment is the so-called ultra high-speed centrifuge that can rotate at a maximum rotation speed of 50,000 rpm or more, for example. In the lower space partitioned by the partition plate 3 in the case 2, a driving part 15 is attached to the partition plate 3 and a motor 17 serving as the driving source is built in a housing 16 of the driving part 15. The driving shaft 14 that extends vertically above the motor 17 passes through the bowl 6 to enter the rotor chamber 8. The rotor 20 is detachably mounted on an upper end of the driving shaft 14.

The rotor 20 is a rotation body for holding and rotating a plurality of the sample containers 30 at a high speed. As the rotor 20 rotates, the sample containers 30 are swung by a centrifugal force in the direction the centrifugal force is applied (radially outward when viewed from the rotation axis), such that the central axis of the sample containers 30 moves from the vertical direction to the horizontal direction. The rotor 20 is rotated by the motor 17 that is included in the driving part 15, and the rotation of the motor 17 is controlled by a control device (not shown).

The decompression chamber 7 is configured to be sealed by the door 5. In a state where the door 5 is opened, the rotor 20 can be mounted in or removed from the rotor chamber 8 in the bowl 6 through an upper opening 18 on the upper side. A cooling device (not shown) for keeping the interior of the rotor chamber 8 at a desired low temperature is connected to the bowl 6. During the centrifugal separation operation, the interior of the rotor chamber 8 is maintained a set environment under control of the control device. An operation display part 19 for the user to input conditions, such as the rotation speed and centrifugal separation time of the rotor, and for displaying various kinds of information is disposed on a side (right side) of the door 5. The operation display part 19 is a combination of a liquid crystal display device and operation buttons, or includes a touch liquid crystal panel, for example.

Figure 2:
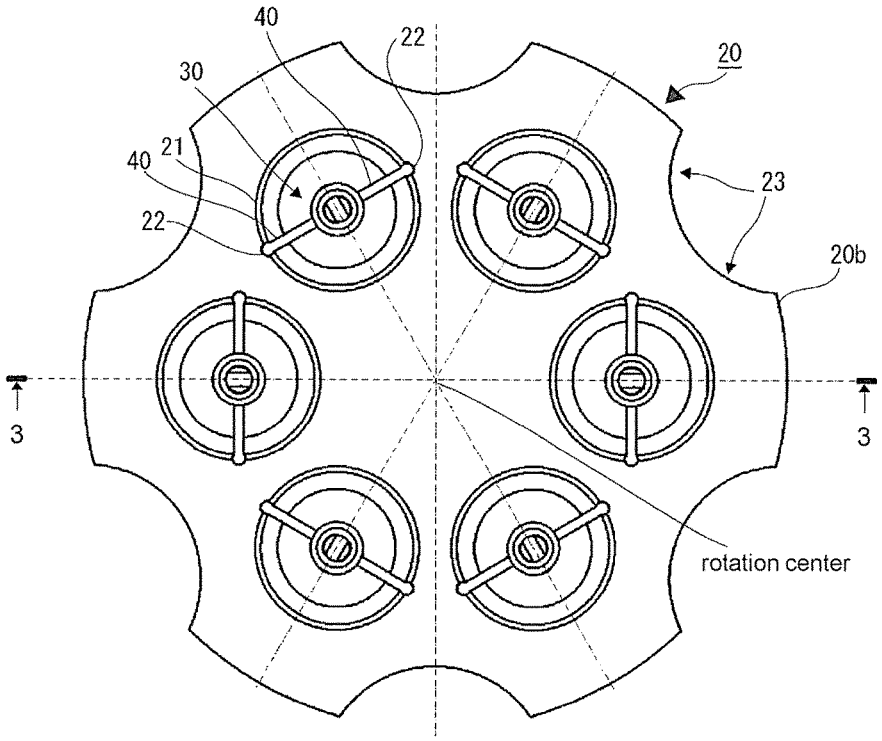
FIG. 2 is a top view showing the configuration of the rotor of FIG. 1.

FIG. 2 illustrates a state where the sample containers 30 are respectively inserted into trough holes 21 of the rotor 20. As shown in FIG. 2, the rotor 20 has a substantially circular shape when viewed from above and has a rotor body 20*b* with a diameter of about 100 mm to 300 mm, in which six through holes 21 having a diameter of about 20 mm to less than 50 mm are formed. The sample containers 30 are installed into the through holes 21 respectively. The sample container 30 is provided with a rotating shaft 40. The sample container 30 is housed in the through hole 21 in a way that the longitudinal direction of the rotating shaft 40 is oriented in the circumferential direction. The through holes 21, each being a cylindrical hole penetrating from the upper side to the lower side, are disposed at equal intervals and are respectively separated 60 degrees in the circumferential direction. The diameter of the hole is slightly larger than the outer diameter of the sample container 30. Two rotating shaft engagement grooves 22, which are separated about 180 degrees in the circumferential direction of the inner wall of each through hole 21, are formed. The rotating shaft engagement grooves 22 extend downward in the axial direction from the upper opening of the through hole 21 to the middle of the through hole 21 without reaching the lower opening. In this way, the rotating shaft engagement grooves 22 serve as holding means for holding two ends of the rotating shaft 40 of the sample container 30. The length of the rotating shaft 40 is slightly larger than the diameter of the through hole 21. Accordingly, if the positions of two ends of the rotating shaft 40 do not match the positions of the rotating shaft engagement grooves 22, the two ends of the rotating shaft 40 will be in contact with the upper end of the through hole 21 and cause that the sample container 30 cannot be inserted to a predetermined position in the through hole 21. If the sample container 30 is inserted downward from the upper side of the through hole 21 with the two ends of the rotating shaft 40 being disposed along the rotating shaft engagement grooves 22, two sides of the rotating shaft 40 are held by the lower ends of the rotating shaft engagement grooves 22, such that the sample container 30 is held and does not fall to the lower side. Because the swing direction of the sample container 30 is in a plane perpendicular to the rotating shaft 40, an angle formed by the rotating shaft 40 and the plane is about 90 degrees. In addition, since it is necessary to make the plane including the swing direction coincide with the direction of action of the centrifugal force, the plane passes through the rotation axis (rotation center) of the driving shaft 14 (FIG. 1). Moreover, the outer edge shape of the rotor 20, as viewed from above, may be substantially circular. In this embodiment, however, in order to reduce the mass, thin parts are formed to reduce the thickness of the portions where bucket housing parts 24 (see FIG. 3) and the through holes 21 are not formed, i.e., the portions indicated by the reference numeral 23.

Figure 3:
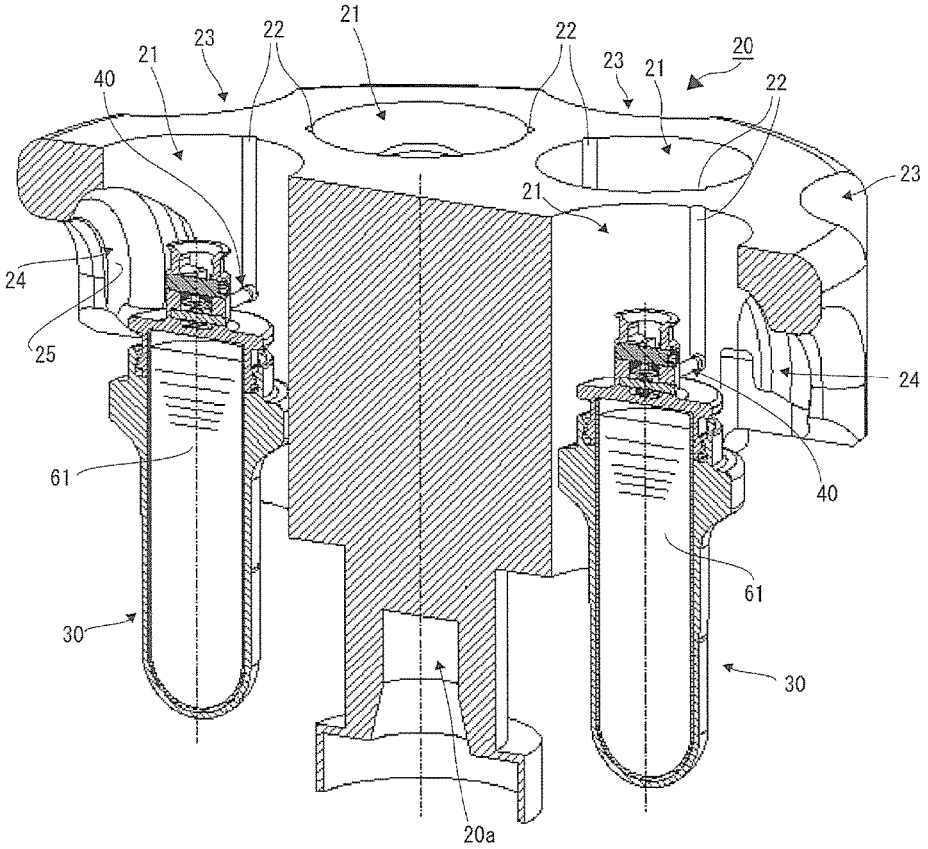
FIG. 3 is a cross-sectional view along the line 3-3 of FIG. 2.

FIG. 3 illustrates a state where the rotor 20 is stopped and the longitudinal direction of the sample container 30 (bucket assembly) is in the vertical direction. Since two ends of the rotating shaft 40 are in contact with the lower ends of the rotating shaft engagement grooves 22, as shown in FIG. 3, the sample container 30 is kept at the position, as shown in the figure, and does not fall off to the lower side from the rotor 20. At the moment, the sample container 30 is held with no contact with the rotor 20, except for two end portions of the rotating shaft 40. When the motor 17 (see FIG. 1) is started to rotate the rotor 20 from this state, the sample container 30 is swung radially outward by the centrifugal force with the rotating shaft 40 as the rotation axis. The swing of the sample container 30 continues until the longitudinal direction of the sample container 30 becomes horizontal (level). The bucket housing part 24 is formed on the rotor 20 in a manner that the swing of the sample container 30 is not hindered by the rotor 20. The bucket housing part 24 is a semi-cylindrical part formed by cutting out a portion of the lower end of the rotor 20 and is a space that is formed to prevent contact between the sample container 30 and the rotor 20, except for particular portions, during the swing of the sample container 30. A driving shaft hole 20*a* is formed in the lower portion of the rotor body 20*b* for attaching a fitting part disposed on the tip of the driving shaft 14.

Figure 4:
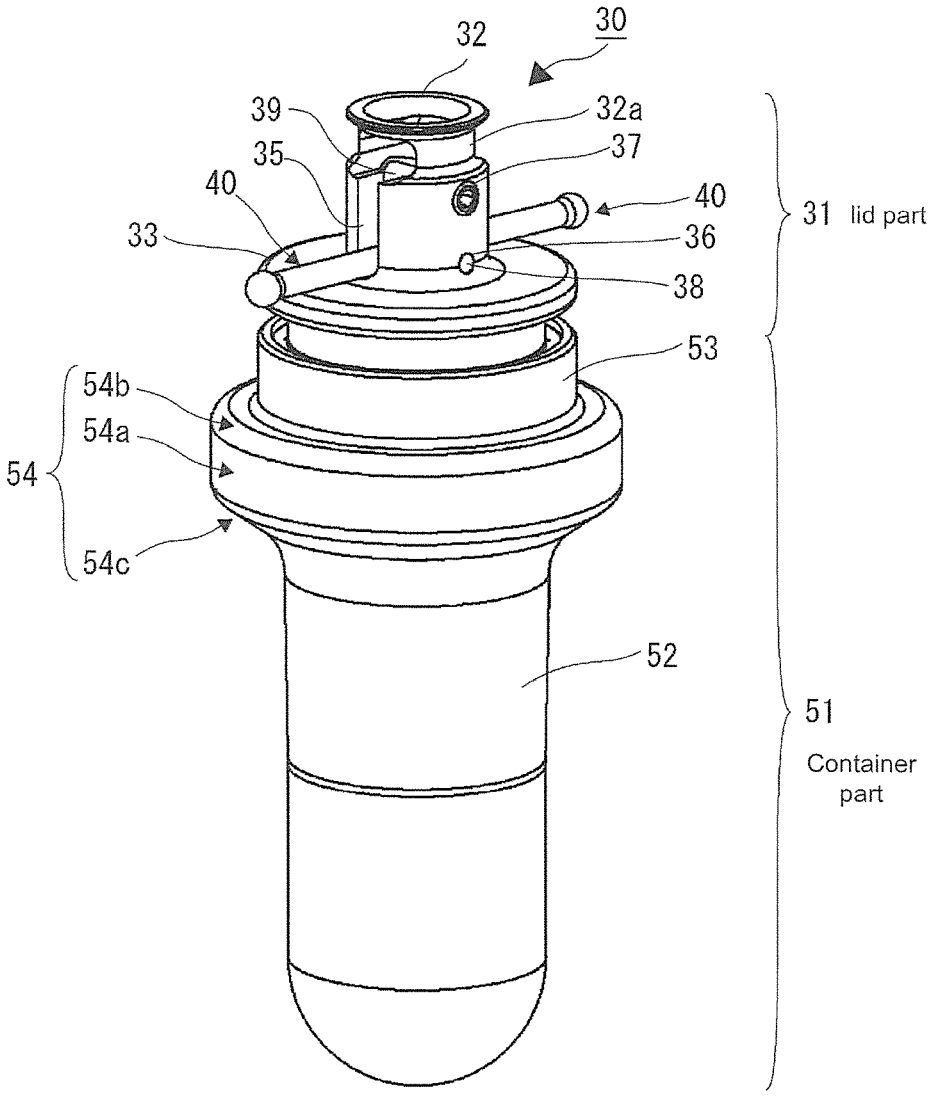
FIG. 4 is a perspective view showing the external configuration of the sample container of FIG. 1.

FIG. 4 illustrates the sample container 30 in a state where a container part 51 is mounted on a lid part 31. Referring to FIG. 4, the container part 51 includes a bucket 52 serving as a container for housing a tube that contains the sample to be separated. The bucket 52 is manufactured integrally by shaving a metal, e.g. a titanium alloy having a high specific strength. A flange part 54 that extends in the radial direction is formed under an opening part 53 of the container part 51. The flange part 54 includes an outer edge part 54*a* and a seating surface 54*c*. The outer edge part 54*a* is smoothly connected to a tapered surface 54*b* from the opening part 53. The seating surface 54*c* is an inclined surface that is formed on the lower side of the outer edge part 54*a* and is continuous in the circumferential direction to be in contact with a sidewall surface (bucket receiving surface 25) of the bucket housing part 24 of the rotor 20. The bucket 52 is connected to the lower side of the seating surface 54*c*. The tapered surface 54*b* has a diameter that gradually decreases from the flange part 54 to the opening part 53 above. The shape of the tapered surface 54*b* can be designed more freely. The seating surface 54*c*, however, is the portion that receives the centrifugal load due to the sample container 30. Therefore, the shapes of the seating surface 54*c* of the flange part 54 and the bucket receiving surface 25 are designed considering the strength. The seating surface 54*c* of this embodiment is configured to smoothly connect the outer edge part 54*a* of the flange part 54 to the cylindrical portion of the bucket 52 below, as shown in FIG. 3, so as to ensure sufficient strength of the container part 51. Moreover, even if the sample container 30 is not in an ideal state and is swung in a slightly obliquely twisted state and causes a side of the body part of the sample container 30 to hit the bucket receiving surface 25 first, the sample container 30 can still be guided by the centrifugal load to place the seating surface 54*c* in a position for favorable surface contact with the bucket receiving surface 25 without being limited by the rotating shaft 40. Thus, the centrifugal load of the sample container 30 and the sample 61 is not applied on the rotating shaft 40.

The lid part 31 functions as a lid for sealing the interior space of the bucket 52. The lid part 31 is mounted to the opening part 53 of the container part 51 by thread coupling or by an insertion system. A disc part 33 having a disc shape to serve as the lid body of the container part 51 is formed near the vertical center of the lid part 31. A cylindrical hollow part 32 that extends upward is formed on the central portion of the upper surface of the disc part 33. A through hole 35 is formed to face the lateral side of the hollow part 32. The hollow portion of the hollow part 32 is opened on top, and the lower end thereof becomes a bottom surface closed by the disc part 33. Then, the rotating shaft 40 passes through the through hole 35 and is disposed to protrude in the radial direction facing the hollow part 32 through the through hole 35. The through hole 35 is not simply a long hole that extends in the direction of action of the centrifugal force, but is formed in a substantially T shape in the side view in this embodiment. The shape will be described in detail later. The lid part 31 is manufactured for example by shaving a metal, such as an aluminum alloy. An installation part 34 (to be described later) is formed on the lower side of the disc part 33 (see FIG. 5). The rotating shaft 40 is to be engaged with the rotating shaft engagement grooves 22 formed on the rotor 20 and serves to support the load of the sample container 30 before the sample container 30 enters the swing state.

Figure 5:
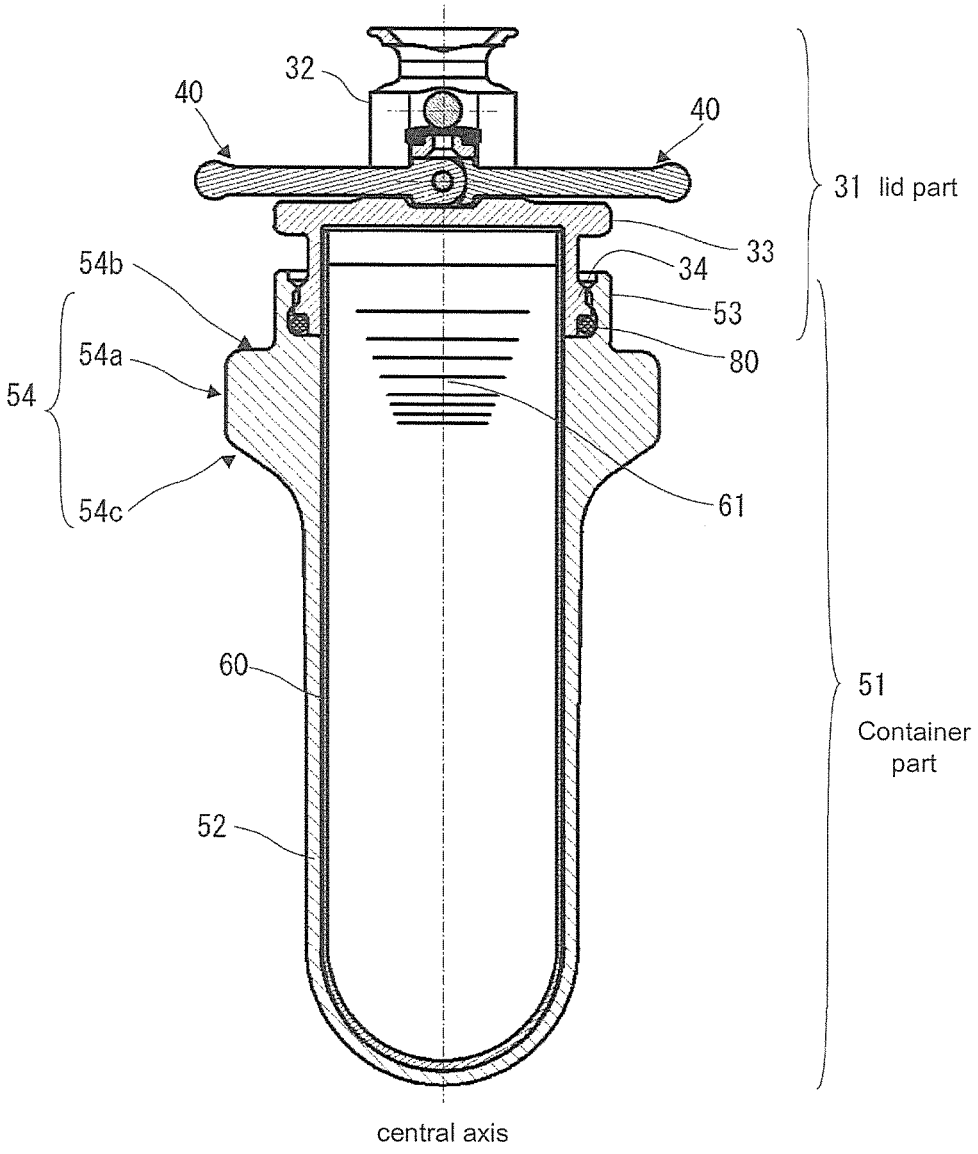
FIG. 5 is a longitudinal cross-sectional view of the sample container of FIG. 1.

As shown in FIG. 5, a space conforming to the outer shape of a tube 60 is formed in the container part 51. The opening part 53 for loading and unloading the tube 60 is formed in the upper portion of the container part 51. The tube 60 is a substantially cylindrical container made of a synthetic resin, for example. The overall length of the tube 60 is about 100 mm and the diameter of the opening part is about 25 mm. The sample 61, which is the target for centrifugal separation, is put in the tube 60. The tube 60 may have various shapes and sizes pursuant to the application or to withstand the centrifugal acceleration required. The lid part 31 mounted to the opening part 53 of the container part 51 covers an opening part of the tube 60 to keep the interior space of the container part 51 in a sealed state, so as to prevent the sample 61 filled in the bucket 52 from leaking outside the bucket 52. A female thread is formed on the inner peripheral side of the opening part 53 of the container part 51 while a male thread is formed on the outer peripheral surface of the installation part 34 of the lid part 31. The male thread of the installation part 34 is screwed to the female thread of the opening part 53 to mount the container part 51 to the lid part 31, so as to seal the interior space of the container part 51 with a sealing member, such as an O-ring 80. Thus, by attaching the lid part 31 to the container part 51, they are integrated and can be swung with the rotating shaft 40 as the fulcrum. Moreover, a contact surface may be formed on the inner peripheral surface of the opening part 53 of the container part 51 and a contact surface may be formed on the outer peripheral surface of the installation part 34 of the lid part 31, and the contact surface of the opening part 53 and the contact surface of the installation part 34 are brought into contact with each other for mounting the container part 51 to the lid part 31.

Figure 6A:
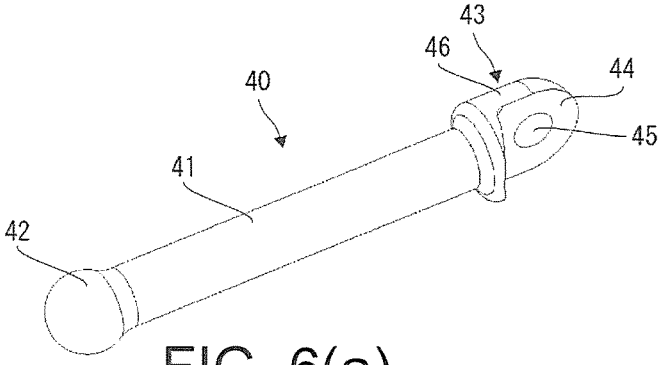
FIGS. 6(*a*)~6(*c*) are views showing the configuration of the rotating shaft of FIG. 2.
Figure 6B:
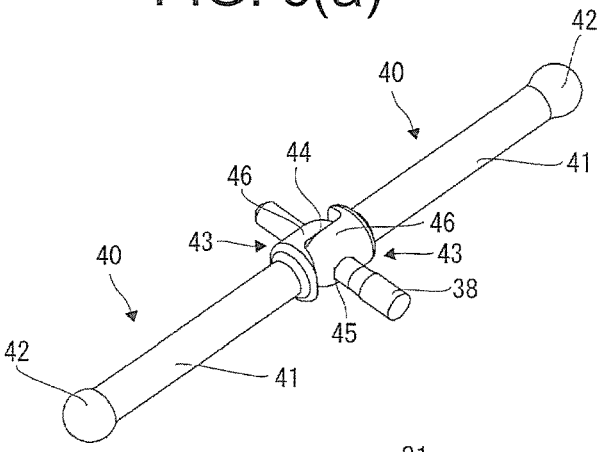
Figure 6C:
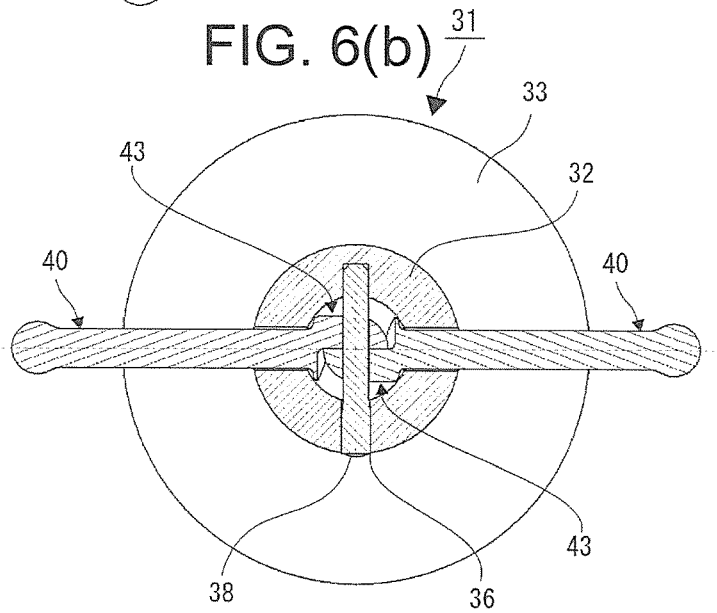

Referring to FIG. 6(*a*), the rotating shaft 40 includes a columnar shaft part 41 and a substantially hemispherical rotating shaft end surface 42 that is formed on one end of the shaft part 41 to be engaged with the rotating shaft engagement groove 22 of the sample container 30. FIG. 6(*a*) is a perspective view of the rotating shaft 40 alone when viewed obliquely from above. A center position of the rotating shaft end surface 42 falls on the axis of the shaft part 41. A connection part 43 is formed on the other end of the shaft part 41 to be connected with another rotating shaft 40. The connection part 43 has a rotating shaft sliding surface 44, which is a plane that falls on the axis of the shaft part 41. A pin sliding hole 45 is formed on the rotating shaft sliding surface 44 to be perpendicular to the rotating shaft sliding surface 44, and an axis of the pin sliding hole 45 intersects the axis of the shaft part 41. The shaft diameter of the shaft part 41 is formed to be smaller than the diameter of the rotating shaft end surface 42. In this way, the weight can be reduced, and the rotating shaft end surface 42 and the rotating shaft engagement groove 22 can be in smooth contact with each other. In addition, the connection part 43 formed with the rotating shaft sliding surface 44 and the pin sliding hole 45 has the largest shaft diameter. It is preferable to set the length of the rotating shaft 40 in the longitudinal direction to about 15 mm to 30 mm and set the shaft diameter of the shaft part 41, i.e., the basic shaft diameter, to about 3 mm, and the weight is preferably set less than 2% of the total weight of the sample container 30 (excluding the sample 61).

Figure 7A:
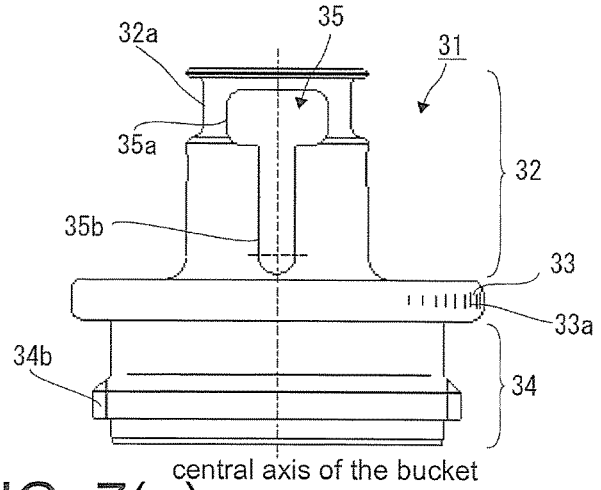
FIGS. 7(*a*)~7(*c*) are views showing the configuration of the lid part of FIG. 4.
Figure 7B:
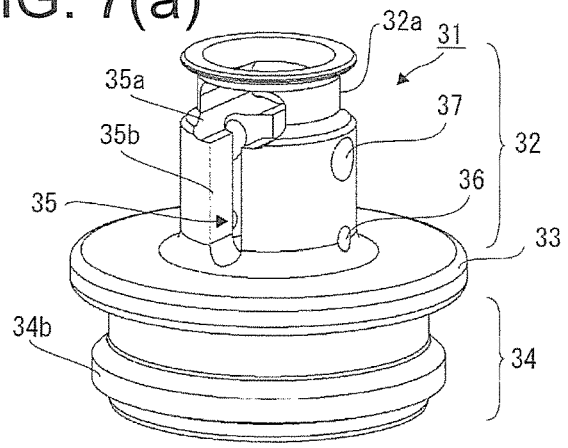
Figure 7C:
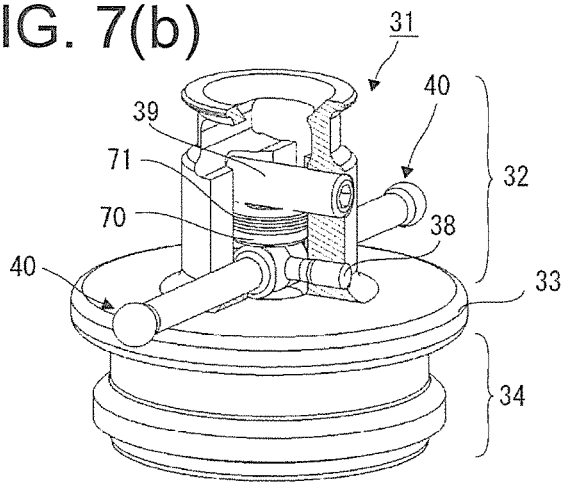

Referring to FIG. 7(*a*) and FIG. 7(*b*), the lid part 31 mainly includes the disc part 33 which is the portion serving as the lid, the hollow part 32 formed above the disc part 33, and the installation part 34 formed under the disc part 33. Further, fine uneven processing 33*a* (knurling, for example) is applied on the outer periphery of the disc part 33 to make the lid part 31 easy to turn by hand when fastening the lid part 31 to the container part 51. FIG. 7(*a*) is a side view of the lid part 31, in which the front of the substantially T-shaped through hole 35 is seen, and FIG. 7(*b*) is a perspective view showing the external shape of the lid part 31. On the side surface of the hollow part 32, the through hole 35 having the substantially T shape in the side view is formed to penetrate from one side to the other side. The through hole 35 can have a rectangular shape or an oval (curve) shape. A longitudinal hole 35*b*, which is a portion of the through hole 35 and is elongated in the vertical direction, is where the rotating shaft 40 passes through. A width of the through hole 35 in the lateral direction (circumferential direction) is set not to interfere with movement of the shaft part 41 of the rotating shaft 40. A circumferential hole 35*a*, which is a portion of the through hole 35 and is wide in the lateral direction (circumferential direction), is an insertion port formed for inserting the connection part 43 of the rotating shaft 40 into the hollow part 32. Then, the connection part 43 of the rotating shaft 40 inserted into the hollow part 32 from the circumferential hole 35*a* has the largest shaft diameter compared to the shaft part 41 and does not pass through the longitudinal hole 35*b*. Accordingly, the shaft part 41 of the rotating shaft 40 with the connection part 43 inserted into the hollow part 32 from the circumferential hole 35*a* is moved in the longitudinal hole 35*b* and is kept from falling off even if the rotating shaft 40 is pulled in the axial direction. In addition, a press-fit hole 36 and a screw hole 37, orthogonal to the through hole 35, are formed in the hollow part 32 to penetrate from one side to the other side. The press-fit hole 36 is formed near the lower end of the longitudinal hole 35*b* while the screw hole 37 is formed above the press-fit hole 36 at a predetermined interval.

An annular groove 32*a* is formed continuous in the circumferential direction near the upper portion of the through hole 35 of the hollow part 32. The annular groove 32*a* helps to reduce the weight and also serves as a knob for handling the lid part 31. The cylindrical installation part 34 is disposed on the lower side of the disc part 33. The installation part 34 is the portion to be engaged with the opening part 53 of the container part 51, and in this embodiment, can be screwed in the axial direction to mount the lid part 31 to or remove the lid part 31 from the container part 51. The installation part 34 is formed with a male thread part 34*b*.

Two rotating shafts 40 are connected opposite to each other, as shown in FIG. 6(*b*), and are assembled to the lid part 31 in such a state, as shown in FIG. 4 and FIG. 5. FIG. 6(*b*) is a perspective view of the two rotating shafts 40 connected by a pin 38 when viewed obliquely from above. As shown in FIG. 6(*c*) and FIG. 7(*c*), the two rotating shafts 40 are respectively disposed in a manner that the connection parts 43 thereof are located in the hollow part 32 with the rotating shaft sliding surfaces 44 facing each other. The pin 38 is pressed into the press-fit hole 36 to pass through the pin sliding holes 45 thereof, by which the two rotating shafts 40 are connected in a state that the rotating shaft sliding surfaces 44 are slidable (a state of being pivotally supported by the pin 38). FIG. 6(*c*) is a cross-sectional view taken along the rotating shafts 40 assembled to the lid part 31 in the horizontal direction, and FIG. 7(*c*) is a partial cross-sectional perspective view showing the configuration of the lid part 31 including the rotating shafts 40.

Figure 8:
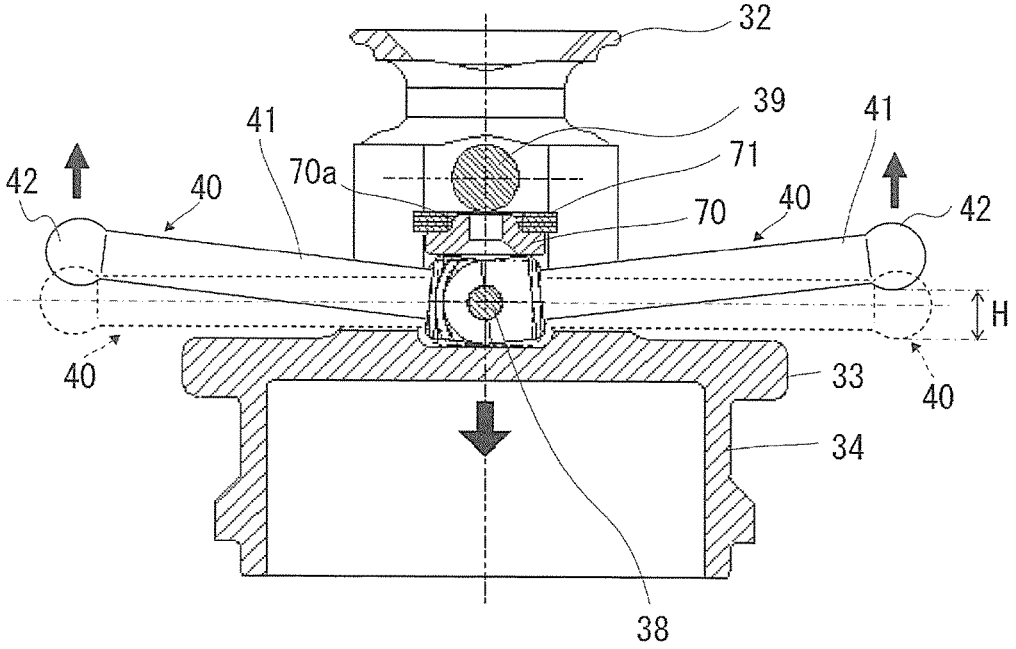
FIG. 8 is a longitudinal cross-sectional view showing the configuration of the lid part of FIG. 4.

As shown in FIG. 7(*c*) and FIG. 8, a spacer 70 is disposed above the rotating shafts 40 (the rotating shaft sliding surfaces 44) connected by the pin 38 in the hollow part 32. The spacer 70 is a disc-like member, and a contact surface on the lower side of the spacer 70, which is in contact with the connection parts 43 of the rotating shafts 40, is a plane surface. A fitting part 70*a* is formed on the upper surface of the spacer 70. The fitting part 70 is a convex part having a circular outer shape. In the hollow part 32, a plurality of disc springs 71 are inserted to be engaged with the fitting part 70*a* of the spacer 70. The disc springs 71 are held by a set screw 39 mounted into the screw hole 37, such that the disc springs 71 are pressed against the connection parts 43 of the rotating shafts 40 and do not fall off. The fitting part 70*a* is fitted to the inner peripheral side of the disc springs 71 for proper retention.

The disc spring 71 is a disc-like spring bulged like a dish and is an elastic body that can be slightly bent to receive a large load or impact. The disc springs 71 function as an urging means for urging the spacer 70 in a direction away from the set screw 39 to press the spacer 70 against the contact surfaces 46 of the connections part 43 from above. Although the configuration is for inserting six disc springs 71 in this embodiment, the number or strength of the disc springs 71 may be set as appropriate considering the maximum rotation speed of the centrifugation, the weight of the container part 51, or the volume of the sample put therein. Without being limited to the disc springs 71, the configuration may also use a compression spring or other resilient members (e.g., metal spring member or resin spring) for urging.

The rotating shafts 40 indicated by the dotted line in FIG. 8 indicate a state where no external force is applied on the disc springs 71, i.e., an urging means. The contact surface 46 of the connection part 43 of the rotating shaft 40, which is in contact with the spacer 70, is parallel to the shaft part 41. Accordingly, due to the urging of the disc springs 71, i.e., the urging means, the spacer 70 is pressed from the upper side of the connection parts 43 of the rotating shafts 40, by which the two rotating shafts 40 (the shaft parts 41) are positioned in a straight line as indicated by the dotted line in FIG. 8.

The rotating shafts 40 indicated by the solid line in FIG. 8 indicate a state where an external force (centrifugal force), as indicated by the arrow, is applied to bend the disc springs 71, i.e., the urging means. A gap between the spacer 70 and the set screw 39 is set to an extent that the disc springs 71 are bent about 0.2 mm so as to maintain constant spring property. Thus, due to the applied external force as indicated by the arrow, the rotating shafts 40 rotate around the pin 38 and are engaged with the longitudinal hole 35*b* to move in the vertical direction. In this way, the two rotating shafts 40 (the shaft parts 41) connected by the mutual connection parts 43 are bent at the connection parts 43. With this structure, a movement distance H of the rotating shafts 40 (the rotating shaft end surfaces 42) with respect to the bending amount of the disc springs 71 disposed in the hollow part 32 is multiplied. The same effect can be achieved even if the disc springs 71 are replaced by other elastic members, such as a coil spring. The lower end of the hollow portion of the hollow part 32 is a bottom surface closed by the disc part 33. The connection parts 43 of the rotating shafts 40 that are incorporated in the hollow part 32 and connected by the pin 38 are configured to leave a gap between the connection parts 43 and the bottom surface. It is for smoothly rotating the rotating shafts 40 around the pin 38 without contacting the bottom surface.

Figure 9:
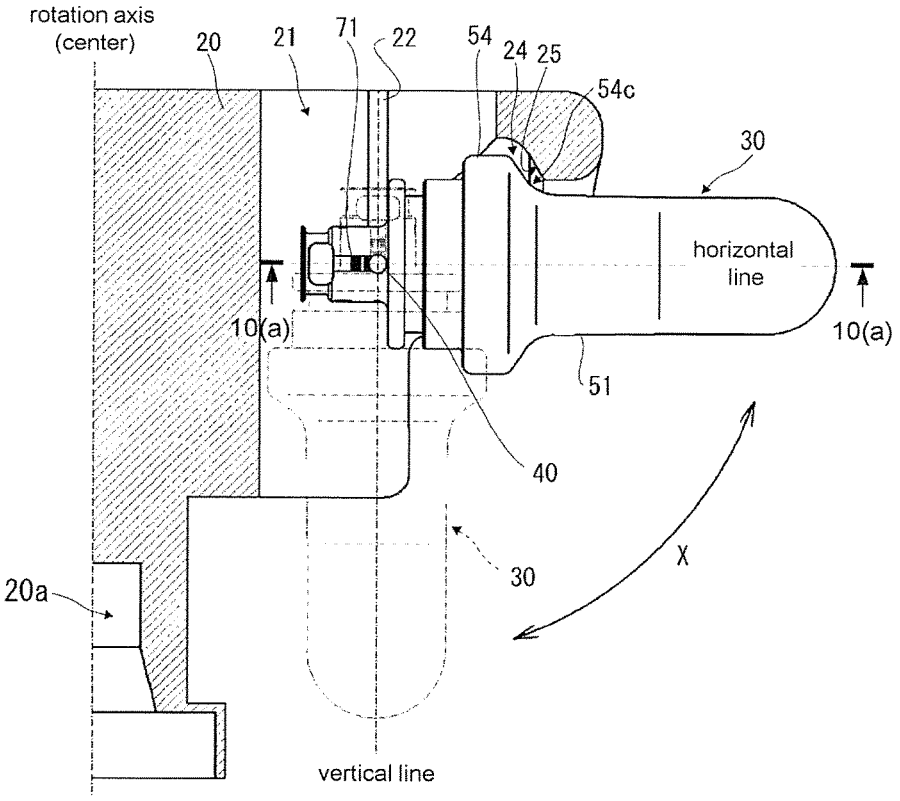
FIG. 9 is a longitudinal cross-sectional view of the rotor of FIG. 1 in the axial direction.

FIG. 9 is a longitudinal cross-sectional view of the rotor 20 of FIG. 1 in the axial direction, wherein the sample container 30 in dotted lines indicates the state when the rotor 20 is stopped and the sample container 30 in solid lines indicates the state when the rotor 20 is rotated. By rotating the rotor 20 at a high speed, the sample container 30 is swung with the rotating shafts 40 as the center, as shown by a swing range X, from the position when the rotor 20 is stopped, as indicated by the dotted lines, to the state when the rotor 20 is rotated, as indicated by the solid lines. Since the rotating shafts 40 are mounted to be rotatable around the vicinity of the lower ends of the rotating shaft engagement grooves 22, when a certain rotation speed is reached, the sample container 30 is swung with the rotating shafts 40 as the swing center and the longitudinal direction of the bucket 52 enters a horizontal state in the horizontal direction. FIG. 9 illustrates a state of low-speed rotation (about 100 rpm to 1,500 rpm, for example) right after the sample container 30 is swung to the horizontal direction. At the low-speed rotation speed right after such horizontal state, the centrifugal force applied on the sample container 30 is small. Thus, the two rotating shafts 40 are maintained in a straight line by the urging force of the disc springs 71, and the seating surface 54*c* of the flange part 54 and the bucket receiving surface 25 of the bucket housing part 24 are maintained in positions that are not in contact with each other. In other words, the disc springs 71 have a strength which is hardly bent by the centrifugal force that is applied in the state of low-speed rotation right after the sample container 30 is swung to the horizontal direction. If the sample container 30 is swung in a state where the two rotating shafts 40 are maintained in a straight line, the seating surface 54*c* of the flange part 54 and the bucket receiving surface 25 of the bucket housing part 24 are disposed in positions that are not in contact with each other. In this way, the sample container 30 does not contact any part of the rotor 20 when being swung from the vertical state to the horizontal state, as indicated by the swing range X, and thus can be swung smoothly.

Figure 10A:
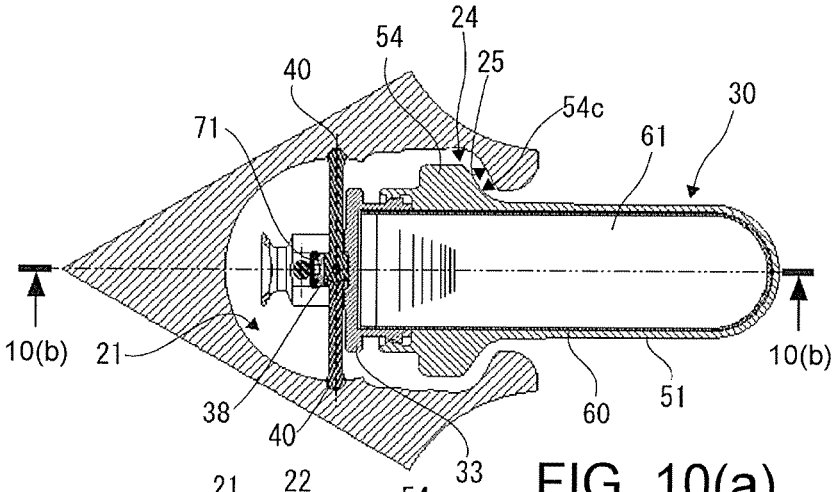
FIGS. 10(*a*)~10(*b*) are views showing a swing state where the rotor of FIG. 1 starts rotating and the sample container has just reached the horizontal state.
Figure 10B:
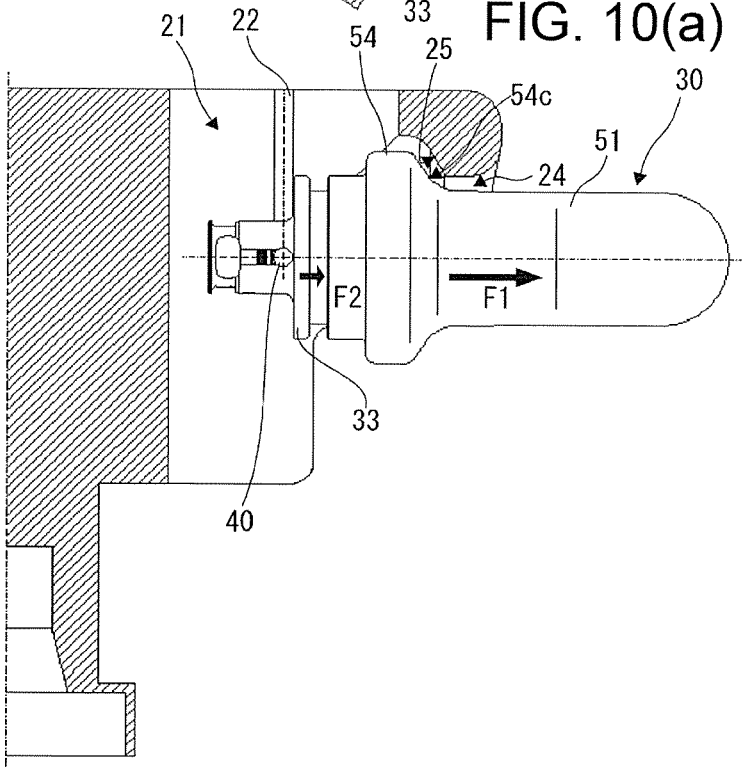
Figure 11A:
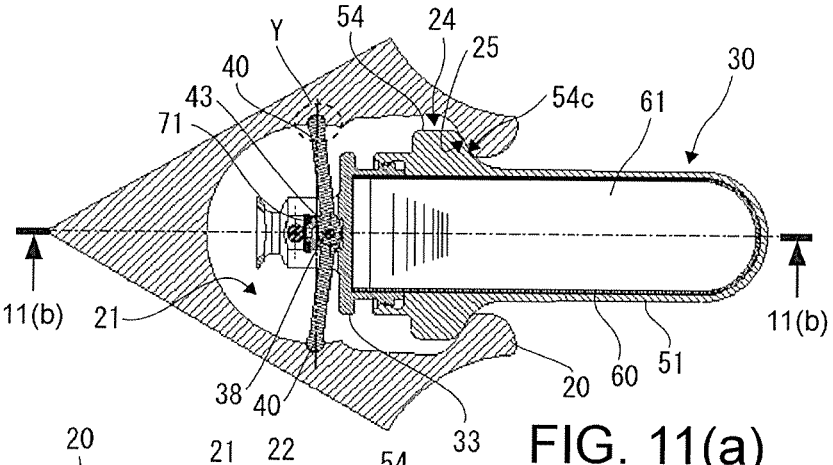
FIGS. 11(*a*)~11(*b*) are views showing a state of the sample container when the rotor of FIG. 1 rotates at a high speed.
Figure 11B:
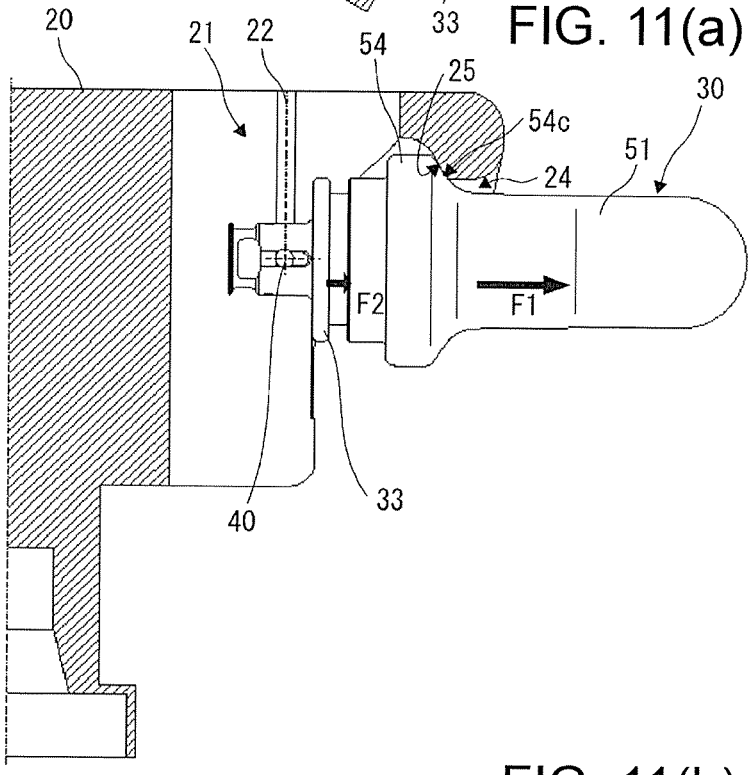

Next, the movement, from the state right after the sample container 30 is swung to the horizontal state, as indicated by the solid lines in FIG. 9, to the state where the rotor 20 is rotated at a higher speed and brings the seating surface 54*c* on the side of the container part 51 into contact with the bucket receiving surface 25 on the side of the rotor 20, is described in detail with reference to FIGS. 10(*a*)~10(*b*) and FIGS. 11(*a*)~11(*b*). FIGS. 10(*a*)~10(*b*) are views showing the swing state where the rotor 20 starts rotating and the sample container 30 has just reached the horizontal state. FIG. 10(*a*) is a partial cross-sectional view of the portion corresponding to the section 10(*a*)-10(*a*) of FIG. 9 and FIG. 10(*b*) is a cross-sectional view of the section 10(*b*)-10(*b*) of FIG. 10(*a*). In addition, FIGS. 11(*a*)~11(*b*) are views showing a state of the sample container 30 when the rotor 20 rotates at a high speed. FIG. 11(*a*) is a partial cross-sectional view of the portion corresponding to the section 10(*a*)-10(*a*) of FIG. 9 and FIG. 11(*b*) is a cross-sectional view of the section 11(*b*)-11(*b*) of FIG. 11(*a*).

As shown in FIGS. 10(*a*)~10(*b*), in the state where the sample container 30 is swung to the horizontal state, a centrifugal load F1 due to the container part 51, the lid part 31, the tube 60, and the sample 61 filled in the tube 60 is applied on the rotating shafts 40 that support the centrifugal load of the sample container 30. Besides, a centrifugal load F2 generated by the weight of the rotating shafts 40, the spacer 70, and the disc springs 71 is also added on the rotating shafts 40. In the state right after the bucket 52 reaches the horizontal direction, the disc springs 71 are not bent and the two rotating shafts 40 are maintained in a substantially straight line. At the moment, a certain gap exists between the wall surface of the rotor 20 (near the bucket receiving surface 25) and the bucket 52 and they are not in contact. They change from this state to the state shown in FIGS. 11(*a*)~11(*b*) when the rotation speed further increases and raises the centrifugal acceleration.

Once a strong centrifugal load is applied on the sample container 30, the centrifugal acceleration exceeds the urging force (load bearing capacity) of the disc springs 71. Thus, the disc springs 71 are bent and the two rotating shafts 40 are bent at the mutual connection parts 43. In this way, the sample container 30 moves toward the outer peripheral side and the gap between the bucket receiving surface 25 and the sample container 30 (the seating surface 54*c* of the flange part 54) is reduced. When the rotation reaches an even higher speed, the sample container 30 moves further in the centrifugal acceleration direction (radially outward), and the bucket receiving surface 25 and the seating surface 54*c* of the flange part 54 are in favorable surface contact. This surface contact state is called "seating" in this embodiment. The rotation speed at the time of the seating is about 2000 rpm to 5000 rpm, for example, and the range of surface contact is about half of the position of the sample container 30 on the upper side of the seating surface 54*c* as viewed in the circumferential direction. Thus, when the rotation speed of the rotor 20 is high, the centrifugal load due to the sample container 30 is received by the large-area bucket receiving surface 25 formed on the rotor 20 because of the seating. Therefore, the centrifugal load F1 due to the container part 51, the lid part 31, and so on is not applied on the rotating shafts 40.

Figure 12A:
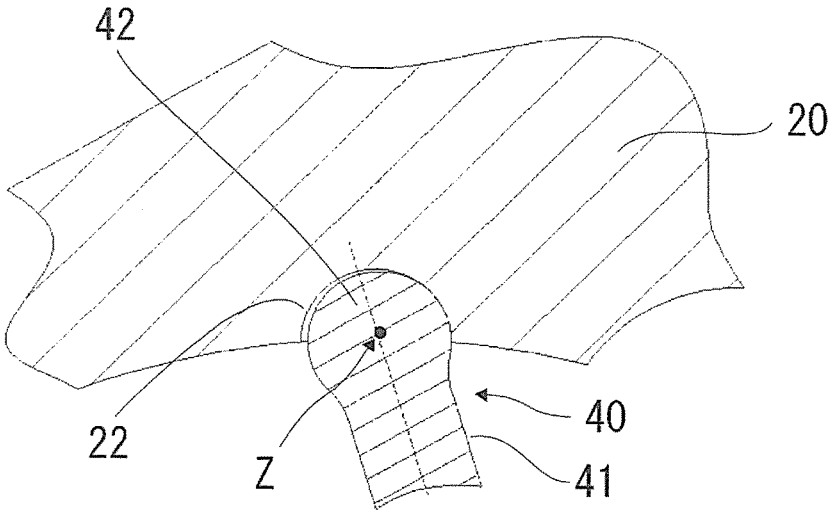
FIGS. 12(*a*)~12(*b*) are diagrams illustrating an engagement state of the rotating shaft and the rotating shaft engagement groove of FIG. 3.
Figure 12B:
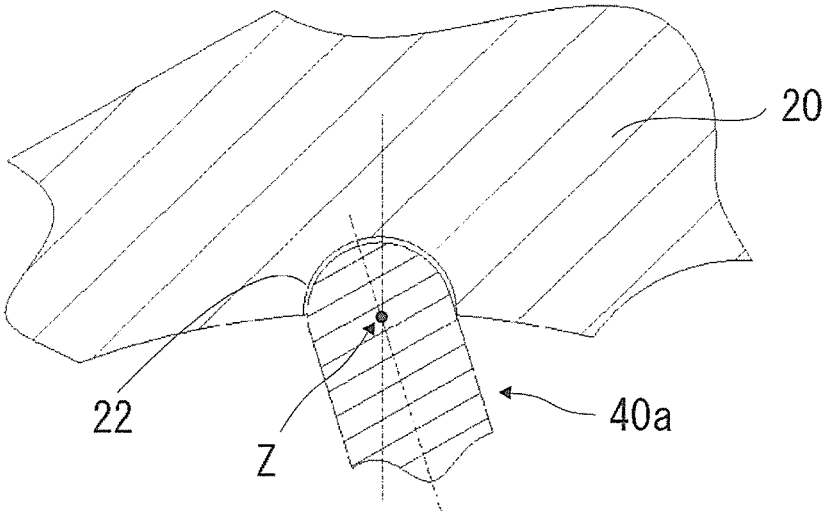

FIG. 12(*a*) is an enlarged view of a region Y shown in FIG. 11(*a*). In this embodiment, the shaft diameter of the shaft part 41 is made smaller than the diameter of the substantially hemispherical rotating shaft end surface 42. Thereby, the rotating shaft 40 is made lighter in weight, and the rotating shaft end surface 42 and the rotating shaft engagement groove 22 can be in smooth contact. That is, by making the shaft diameter of the shaft part 41 smaller than the diameter of the rotating shaft end surface 42, as shown in FIG. 12(*a*), a movable range of the rotating shaft end surface 42 in the rotating shaft engagement groove 22 is secured, and even if the two rotating shafts 40 are bent at the mutual connection parts 43, the rotating shaft engagement groove 22 and the rotating shaft end surface 42 can still be in surface contact and remain in a favorable contact state. In contrast thereto, in the case of using a rotating shaft 40*a* that the shaft diameter of the shaft part is not smaller than the rotating shaft end surface, as shown in FIG. 12(*b*), the corner of the rotating shaft engagement groove 22 will come into contact with the rotating shaft 40*a* as the rotating shafts 40 are bent. Thus, it results in point or line contact and a favorable contact state cannot be maintained.

For example, the weight of the rotating shaft 40 is about 3 g (less than 2% of the sample container 30). When the rotor 20 rotates at a rotation speed of 32,000 rpm, the centrifugal load of the rotating shaft 40 alone is about 300 kg and it is difficult to support the centrifugal load generated by the weight of the rotating shaft 40 only with two ends of the rotating shaft 40. In order to withstand the centrifugal load, it is considered to increase the strength of the rotating shafts 40. However, the increase of the strength usually raises the weight and therefore further increases the centrifugal load. Here, in this embodiment, the configuration uses two rotating shafts 40, and the shape is determined in order to reduce the centrifugal load applied on one rotating shaft 40 and the bending moment and further to reduce the shaft diameter of the shaft part 41 and the weight, and the two rotating shafts 40 are connected at the mutual connection parts 43, such that the two rotating shafts 40 are bendable at the connection parts 43 by the centrifugal load. In other words, the conventional configuration that uses one single rotating shaft to support the long distance between the rotating shaft engagement grooves 22 is changed to a structure that the length of the rotating shaft 40 is set to about half of the length between the rotating shaft engagement grooves 22, so as to withstand even higher centrifugal acceleration without breaking the rotating shaft 40, which has the thickness, length, and material that are breakable according to the conventional technology. According to this structure, the rotating shafts 40 can be used sufficiently without breakage even under a high centrifugal acceleration that is intolerable for a single structure.

Second Embodiment

Figure 13A:
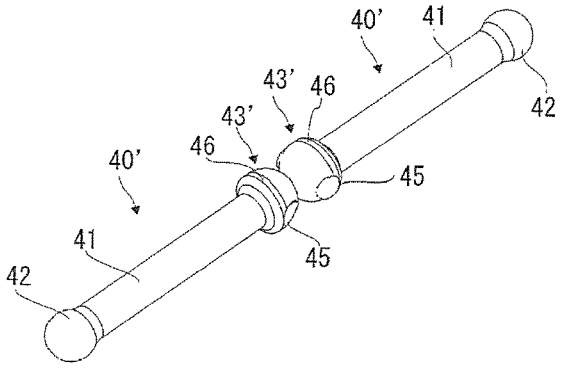
FIGS. 13(*a*)~13(*c*) are views showing another example of the configuration of the rotating shaft of FIGS. 6(*a*)~6(*c*).
Figure 13B:
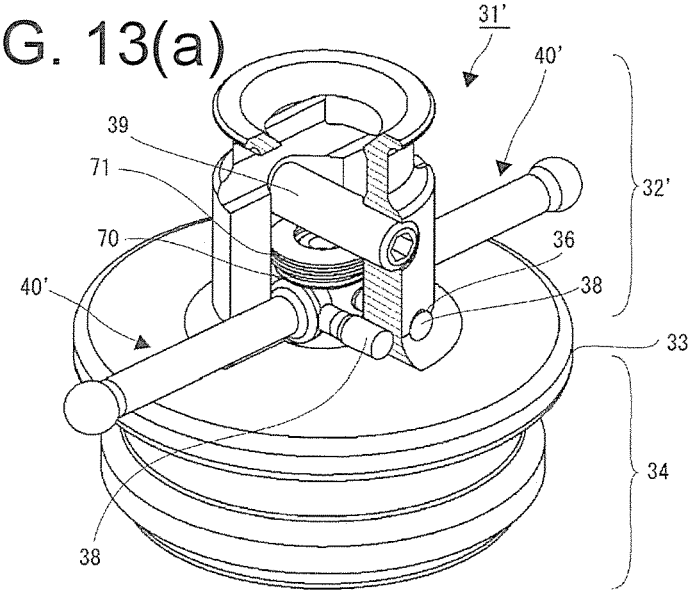
Figure 13C:
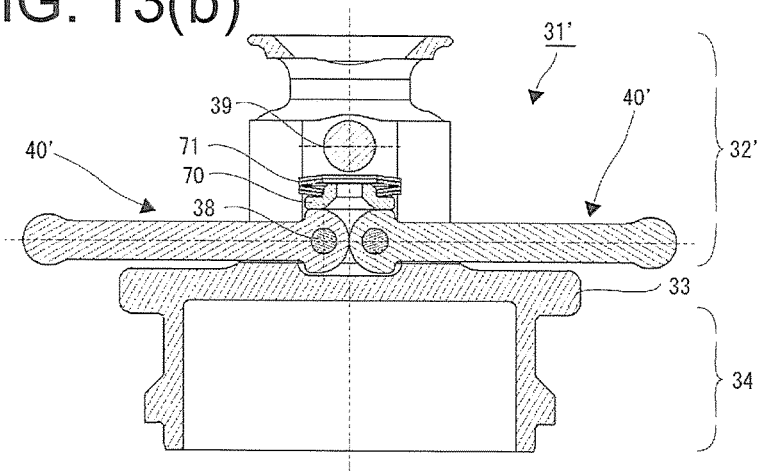

In the second embodiment, referring to FIGS. 13(*a*)~13(*c*), two rotating shafts 40' are connected via a hollow part 32' of a lid part 31. FIG. 13(*a*) is a perspective view showing the configuration of the rotating shafts 40', FIG. 13(*b*) is a partial cross-sectional perspective view showing the configuration of the lid part 31' including the rotating shafts 40', and FIG. 13(*c*) is a longitudinal cross-sectional view showing the configuration of the lid part 31' including the rotating shafts 40'.

As shown in FIG. 13(*a*), a connection part 43' of the rotating shaft 40' does not have the rotating shaft sliding surface 44 that the rotating shaft 40 has in the first embodiment, but has the pin sliding hole 45 and the contact surface 46. As shown in FIG. 13(*b*), two press-fit holes 36 (one of the press-fit holes 36 is not shown) are formed side by side in the horizontal direction on the peripheral surface of the hollow part 32' of the lid part 31'. As shown in FIG. 13(*b*) and FIG. 13(*c*), the two rotating shafts 40' are disposed in a manner that the respective connection parts 43' are located in the hollow part 32' of the lid part 31'. The pins 38 are respectively pressed into the two press-fit holes 36 to pass through the respective pin sliding holes 45, by which the two rotating shafts 40' are pivotally supported in the hollow part 32' respectively. Then, like the first embodiment, the spacer 70 and the disc springs 71 are interposed between the contact surfaces 46 of the connection parts 43' and the set screw 39.

In the second embodiment, it is necessary to respectively assemble the two rotating shafts 40' into the hollow part 32'. Therefore, the work processes increase. However, because it is not required to match two pin sliding holes 45 for inserting the pin 38 as in the first embodiment, the assembling process itself can be carried out easily.

Third Embodiment

Figure 14A:
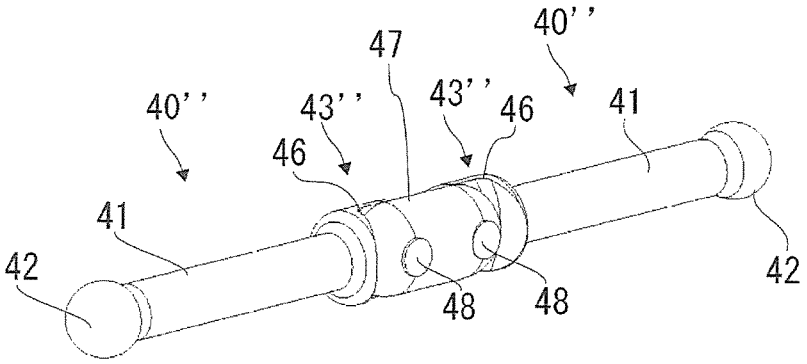
FIGS. 14(*a*)~14(*b*) are views showing another example of the configuration of the rotating shaft of FIGS. 6(*a*)~6(*c*).
Figure 14B:
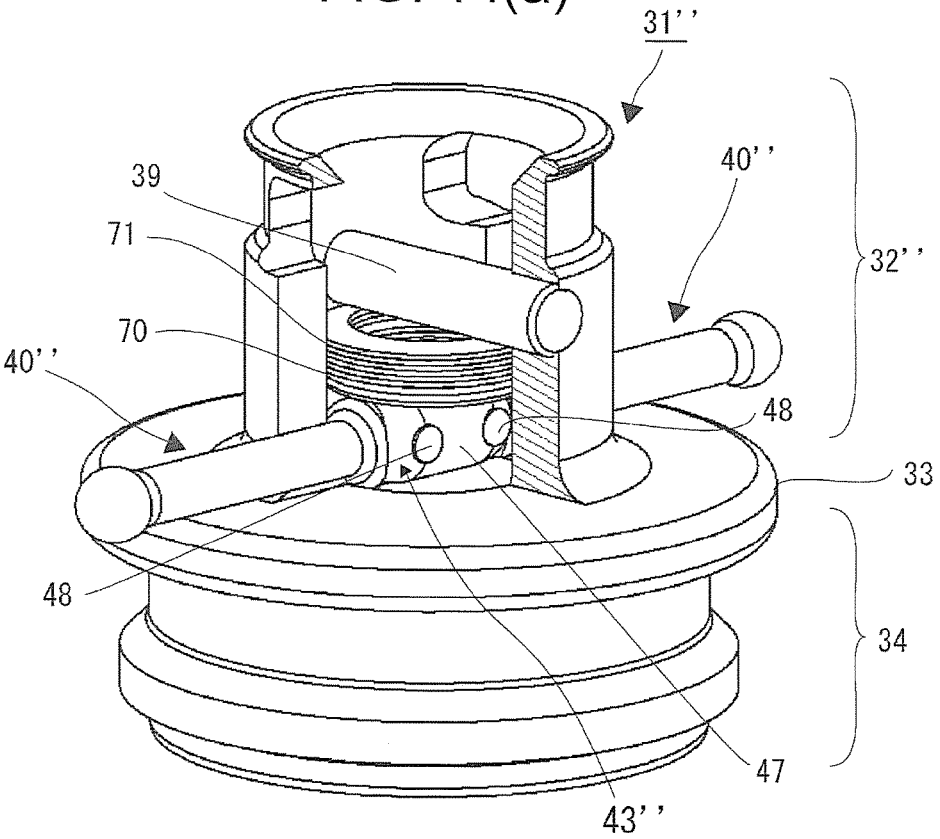

In the third embodiment, referring to FIGS. 14(*a*)~14(*b*), two rotating shafts 40" are connected via an intermediate member 47. FIG. 14(*a*) is a perspective view showing the configuration of the rotating shafts 40" and FIG. 14(*b*) is a partial cross-sectional perspective view showing the configuration of a lid part 31" including the rotating shafts 40".

As shown in FIG. 14(*a*), the connection parts 43" of the two rotating shafts 40" are respectively connected to the intermediate member 47 by a pin 48. The pins 48 respectively connecting the two rotating shafts 40" to the intermediate member 47 are set in parallel. Then, as shown in FIG. 14(*b*), the two rotating shafts 40" connected via the intermediate member 47 are disposed such that the mutual connection parts 43" and the intermediate member 47 are located in the hollow part 32" of the lid part 31", and like the first embodiment, the spacer 70 and the disc springs 71 are interposed between the contact surfaces 46 of the connection parts 43" and the set screw 39.

According to the third embodiment, a work process for connecting the two rotating shafts 40" needs to be performed in advance. However, it is not required to form the press-fit hole 36 in the hollow part 32" and the assembly of the rotating shafts 40" to the hollow part 32" can be carried out easily.

Fourth Embodiment

Figure 15A:
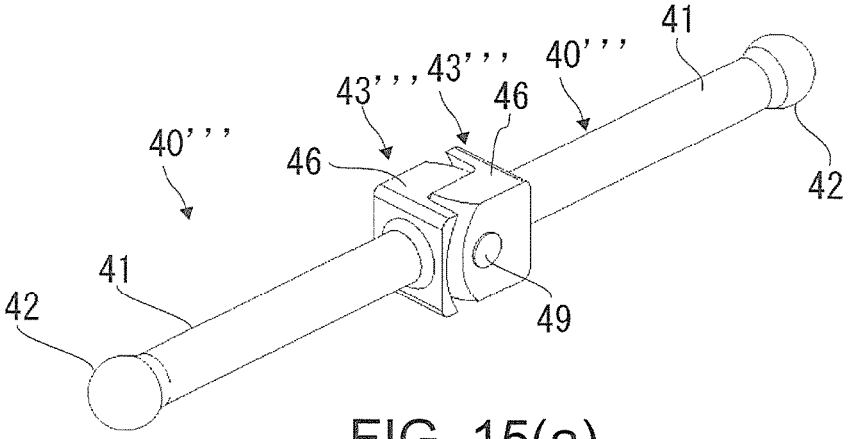
FIGS. 15(*a*)~15(*b*) are views showing another example of the configuration of the rotating shaft of FIGS. 6(*a*)~6(*c*).
Figure 15B:
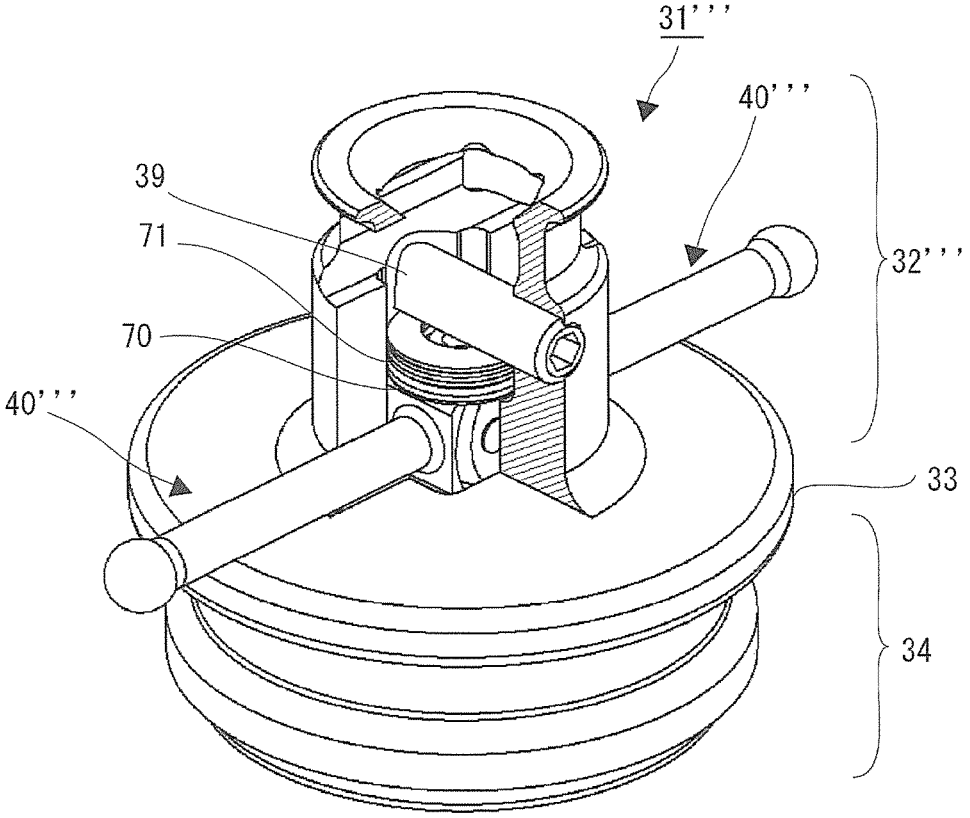

In the fourth embodiment, referring to FIGS. 15(*a*)~15(*b*), two rotating shafts 40" are connected by a pin 49 before being incorporated into a lid part 31". FIG. 15(*a*) is a perspective view showing the configuration of the rotating shafts 40" and FIG. 15(*b*) is a partial cross-sectional perspective view showing the configuration of the lid part 31'" including the rotating shafts 40'".

As shown in FIG. 15(*a*), the connection parts 43'" of the two rotating shafts 40'" are directly connected by the pin 49. Then, as shown in FIG. 15(*b*), the two rotating shafts 40'" directly connected by the pin 49 are disposed such that the mutual connection parts 43'" are located in the hollow part 32'" of the lid part 31'", and like the first embodiment, the spacer 70 and the disc springs 71 are interposed between the contact surfaces 46 of the connection parts 43'" and the set screw 39.

According to the fourth embodiment, a work process for connecting the two rotating shafts 40'" needs to be performed in advance. However, it is not required to form the press-fit hole 36 in the hollow part 32''' and the assembly of the rotating shafts 40''' to the hollow part 32''' can be carried out easily.

In the embodiment, as described above, the centrifuge 1 includes the sample container 30 including the rotating shafts 40 for swing and the swing type rotor. The swing type rotor includes the through hole 21 that penetrates from the upper side to the lower side in the axial direction, the rotating shaft engagement grooves 22 that serve as a pair of support parts rotatably supporting two ends of the rotating shafts 40 of the sample container 30 mounted in the through hole 21, and the bucket housing part 24 that is a cutout part formed on the radial outer side in the direction perpendicular to the central axis of the through hole 21. The centrifuge 1 swings the sample container 30 with the rotating shafts 40 mounted to the rotating shaft engagement grooves 22 by rotation of the rotor 20 and performs centrifugation operation in the state where the sample container 30 is seated on the bucket housing part 24. The rotating shafts 40 include a plurality of members connected by the connection parts 43 and are bendable at the connection parts 43 by the centrifugal load that accompanies the rotation of the rotor 20. With this configuration, the load weight applied on the rotating shafts 40 and the bending moment can be significantly reduced to half or less of those of the conventional technology, and the rotating shafts 40 can be used without breakage or deformation even if the rotating shafts 40 are made to be light in weight and repeatedly receive bending stress in each centrifugation operation. Since the load weight on the rotor 20 can be reduced, the lifespan of the rotor 20 and the rotating shafts 40 can be prolonged to achieve cost reduction.

Furthermore, according to the embodiment, after the sample container 30 is swung to the horizontal direction by the rotation of the rotor 20, the sample container 30 is seated on the bucket housing part 24 by the bending of the rotating shafts 40 at the connection parts 43. With this configuration, breakage of the rotating shafts 40 can be prevented and the bending amount of the rotating shafts 40 can be significantly increased (around 3 mm). Therefore, the sample container 30 can be seated with a sufficient margin even if the gap between the rotor 20 (the bucket housing part 24) and the sample container 30 varies. Moreover, in the case of the conventional integral structure, the sample container 30 is allowed to have a deformation amount only in the range within the elasticity limit of the material thereof and a sufficient movement distance cannot be ensured. The bending of the rotating shafts 40 at the connection parts 43 makes it possible to ensure a sufficient movement distance for the sample container 30, and the high-performance centrifuge 1 is able to achieve prevention of breakage of the rotating shafts 40 as well as spring property.

In addition, according to the embodiment, the sample container 30 includes the container part 51 for housing the sample and the lid part 31 for sealing the container part 51. The container part 51 is formed with the seating surface 54*c* to be seated on the bucket housing part 24 during the swing. The lid part 31 includes the disc part 33 for covering the opening part 53 of the container part 51 and the hollow part 32 formed integrally above the disc part 33. The rotating shafts 40 are assembled such that the connection parts 43 are located in the hollow part 32. The urging means (the disc springs 71) for urging such that the connection parts 43 are not bent is disposed in the hollow part 32. With this configuration, the spring property can be ensured for seating the seating surface 54*c* of the sample container 30 on the rotor 20 (the bucket housing part 24).

Furthermore, according to the embodiment, the longitudinal hole 35*b*, which is penetrated by the rotating shafts 40 and has a predetermined length in the longitudinal direction of the container part 51, is formed in the hollow part 32 to serve as the through hole 35, and the rotating shafts 40 that protrude from the longitudinal hole 35*b* on two sides are respectively movable in the longitudinal direction along the longitudinal hole 35*b* by the bending at the connection parts 43. With this configuration, the rotating shafts 40 are movable while sliding in parallel to the opening ridge of the longitudinal hole 35*b*. Thus, the sample container 30 can be moved by sliding while being engaged with the rotating shafts 40. It is possible not to cause any unnecessary vibration to the sample, and breakage of the rotating shafts themselves due to the centrifugal load in the ultra high-speed rotation range can be prevented effectively.

Besides, according to the embodiment, the shaft diameter of the shaft part 41 of the rotating shaft 40 is smaller than the shaft diameter of the connection part 43, and the through hole 35 is formed in a substantially T shape in the side view by the circumferential hole 35*a* and the longitudinal hole 35*b*, wherein he circumferential hole 35*a* has a predetermined length in the circumferential direction for inserting the connection part 43 of the rotating shaft 40 into the hollow part 32. With this configuration, the shaft part 41 of the rotating shaft 40 with the connection part 43 inserted into the hollow part 32 from the circumferential hole 35*a* is moved in the longitudinal hole 35*b*, so as to effectively prevent the rotating shaft 40 from falling off from the hollow part 32.

Moreover, according to the embodiment, the rotating shafts 40 are connected rotatably at the connection parts 43 by the pin 38 disposed in the hollow part 32 and are bendable with the pin 38 as the fulcrum. With this configuration, the rotating shafts 40 can be bent easily at the connection parts 43 and a sufficient movement distance can be ensured for the sample container 30.

In addition, according to the embodiment, the rotating shafts 40 supports the centrifugal load by the pair of rotating shaft engagement grooves 22 of the rotor 20 and the pin 38 during the centrifugation operation in the state where the sample container 30 is seated on the bucket housing part 24. With this configuration, the centrifugal load supported by the pair of rotating shaft engagement grooves 22 can be reduced.

Moreover, according to the embodiment, the connection part 43 has the contact surface 46 that is parallel to the axial direction of the rotating shaft 40, and the urging means (the disc springs 71) urges the spacer 70 having a planar contact surface toward the contact surface 46 of the connection part 43. With this configuration, the rotating shafts 40 are maintained in a straight line when no centrifugal load is applied. Therefore, the sample container 30 can be swung smoothly.

Furthermore, according to the embodiment, the urging means (the disc springs 71) and the spacer 70 are interposed between a stopper (the screw 39) disposed in the hollow part 32 and the contact surfaces of the connection parts 43. With this configuration, the movement distance H of the rotating shafts 40 with respect to the bending amount of the disc springs 71 disposed in the hollow part 32 is multiplied. The urging means disposed in the hollow part 32 is smaller and lighter, and the load weight applied on the rotating shafts 40 and the bending moment can be significantly reduced.

Additionally, according to the embodiment, the two ends of the rotating shafts 40 supported by the rotating shaft engagement grooves 22 of the rotor 20 respectively have the substantially hemispherical rotating shaft end surfaces 42, and the shaft diameter of the shaft part 41 of the rotating shaft 40 is made smaller than the diameter of the rotating shaft end surface 42. With this configuration, even if the rotating shafts 40 are bent at the connection parts 43, the rotating shaft engagement grooves 22 and the rotating shaft end surfaces 42 can still be in surface contact and remain in a favorable contact state.

Further, the embodiment is the sample container 30 for the centrifuge 1 including the swing type rotor 20, and includes the rotating shafts 40 that are supported by a pair of support parts formed in the through hole 21 that penetrates from the upper side to the lower side in the axial direction of the rotor 20 and serve as the shaft for swing by the rotation of the rotor 20. The rotating shafts 40 include a plurality of members connected by the connection parts 43 and are bendable at the connection parts 43 by the centrifugal load that accompanies the rotation of the rotor 20.

Although the invention has been described above based on the embodiments, the invention should not be construed as limited to the aforementioned embodiments, and various modifications may be made without departing from the spirit of the invention. For example, the shape of the rotating shaft 40 is not necessarily columnar, as described in the above embodiments. The cross-sectional shape perpendicular to the longitudinal direction may be substantially quadrangular or elliptical and only the portion to be engaged with the rotating shaft engagement groove 22 is hemispherical.

DESCRIPTION OF REFERENCE NUMERALS

1 . . . centrifuge; 2 . . . case; 3 . . . partition plate; 4 . . . protective wall; 5 . . . door; 6 . . . bowl; 7 . . . decompression chamber; 8 . . . rotor chamber; 9 . . . oil diffusion vacuum pump; 10 . . . oil rotation vacuum pump; 11 . . . vacuum drawing opening; 12, 13 . . . vacuum pipe; 14 . . . driving shaft; 15 . . . driving part; 16 . . . housing; 17 . . . motor; 18 . . . upper opening; 19 . . . operation display part; 20 . . . rotor; 20*a* . . . driving shaft hole; 20*b* . . . rotor body; 21 . . . through hole; 22 . . . rotating shaft engagement groove; 23 . . . thin part; 24 . . . bucket housing part; 25 . . . bucket receiving surface; 30 . . . sample container; 31, 31', 31", 31'" . . . lid part; 32, 32', 32", 32'" . . . hollow part; 32*a* . . . annular groove; 33 . . . disc part; 33*a* . . . uneven processing; 34 . . . installation part; 34*b* . . . male thread part; 35 . . . through hole; 35*a* . . . circumferential hole; 35*b* . . . longitudinal hole; 36 . . . press-fit hole; 37 . . . screw hole; 38 . . . pin; 39 . . . set screw; 40, 40', 40", 40'" . . . rotating shaft; 41 . . . shaft part; 42 . . . rotating shaft end surface; 43, 43', 43", 43'" . . . connection part; 44 . . . rotating shaft sliding surface; 45 . . . pin sliding hole; 46 . . . contact surface; 47 . . . intermediate member; 48 . . . pin; 49 . . . pin; 51 . . . container part; 52 . . . bucket; 53 . . . opening part; 54 . . . flange part; 54*a* . . . outer edge part; 54*b* . . . tapered surface; 54*c* . . . seating surface; 60 . . . tube; 61 . . . sample; 70 . . . spacer; 70*a* . . . fitting part; 71 . . . disc spring; 80 . . . O-ring; F1, F2 . . . centrifugal load; H . . . movement distance of the rotating shaft; X . . . swing range

What is claimed is:

1. A centrifuge comprising:

a sample container, which comprises a pair of rotating shafts for swing, wherein each of the rotating shafts has two ends, one of the two ends of each of the rotating shafts has a connection part; and a swing type rotor, which comprises a through hole penetrating from an upper side to a lower side in an axial direction, a pair of support parts rotatably supporting the other of the two ends of each of the rotating shafts of the sample container mounted in the through hole, and a cutout part formed on a radial outer side in a direction perpendicular to a central axis of the through hole, and swinging the sample container with the rotating shafts mounted to the support parts by rotation of the rotor to perform a centrifugation operation in a state where the sample container is seated on the cutout part, wherein the rotating shafts are connected with each other through the connection part and are pivotally supported at the connection part by a centrifugal load that accompanies the rotation of the rotor.

2. The centrifuge according to claim 1, wherein after the sample container is swung by the rotation of the rotor, the sample container is seated on the cutout part by rotating of the rotating shafts at the connection part.

3. The centrifuge according to claim 1, wherein the sample container comprises a container part housing a sample and a lid part sealing the container part, the container part comprises a seating surface to be seated on the cutout part during the swing, the lid part comprises a disc part for covering an opening part of the container part and a hollow part formed integrally above the disc part, each of the rotating shafts is assembled such that the connection part is located in the hollow part, and a spring device is disposed in the hollow part for urging such that the connection part is not bent.

4. The centrifuge according to claim 3, wherein the hollow part comprises a longitudinal hole as a hollow part through hole which is penetrated by each of the rotating shafts and has a predetermined length in a longitudinal direction of the container part, and each of the rotating shafts protruding from the longitudinal hole on two sides is respectively movable in the longitudinal direction along the longitudinal hole by rotating the rotating shafts at the connection part.

5. The centrifuge according to claim 4, wherein a shaft diameter of a shaft part of each of the rotating shafts is smaller than a diameter of the connection part, and the hollow part through hole is formed in a substantially T shape in a side view by a circumferential hole and the longitudinal hole, wherein the circumferential hole has a predetermined length in a circumferential direction for inserting the connection part of each of the rotating shafts into the hollow part.

6. The centrifuge according to claim 3, wherein each of the rotating shafts is connected rotatably at the connection part by a pin disposed in the hollow part and is rotatable with the pin as a fulcrum.

7. The centrifuge according to claim 6, wherein with respect to each of the rotating shafts, the centrifugal load is supported by the pair of support parts of the rotor and the pin in the centrifugation operation in the state where the sample container is seated on the cutout part.

8. The centrifuge according to claim 3, wherein the connection part comprises a contact surface that is parallel to an axial direction of each of the rotating shafts, and the spring device urges a spacer having a planar contact surface toward the contact surface of the connection part.

9. The centrifuge according to claim 8, wherein the spring device and the spacer are interposed between a stopper disposed in the hollow part and the contact surface of the connection part.

10. The centrifuge according to claim 9, wherein the spring device is a plurality of stacked disc springs, and the stopper is a screw that is screwed in a direction perpendicular to an axial direction of the hollow part.

11. The centrifuge according to claim 1, wherein the other ends of the two ends of each of the rotating shafts supported by the support parts of the rotor respectively comprise a substantially hemispherical rotating shaft end surface, and a shaft diameter of a shaft part of each of the rotating shafts is smaller than a diameter of the rotating shaft end surface.

12. The centrifuge according to claim 1, wherein the rotating shafts are connected with each other thorough an intermediate member.

13. A swing rotor for a centrifuge, comprising:

a through hole penetrating from an upper side to a lower side in an axial direction, a pair of support parts rotatably supporting a pair of rotating shafts of a sample container mounted in the through hole, wherein each of the rotating shafts has two ends, one of the two ends of each of the rotating shafts has a connection part, the other of the two ends of each of the rotating shafts are mounted in the through hole; and a cutout part formed on a radial outer side in a direction perpendicular to a central axis of the through hole, wherein the rotating shafts are connected with each other through the connection part and are pivotally supported at the connection part by a centrifugal load that accompanies rotation of the rotor.

14. The swing rotor according to claim 13, wherein the rotating shafts are connected with each other thorough an intermediate member.

* * * * *